US007263195B2

(12) United States Patent
Harvey et al.

(10) Patent No.: US 7,263,195 B2
(45) **Date of Patent: *Aug. 28, 2007**

(54) IN-EAR MONITOR WITH SHAPED DUAL BORE

(75) Inventors: Jerry J. Harvey, Las Vegas, NV (US); Medford Alan Dyer, San Diego, CA (US)

(73) Assignee: Ultimate Ears, LLC, Irvine, CA (US)

( * ) Notice: Subject to any disclaimer, the term of this patent is extended or adjusted under 35 U.S.C. 154(b) by 392 days.

This patent is subject to a terminal disclaimer.

(21) Appl. No.: 11/051,865

(22) Filed: Feb. 4, 2005

(65) Prior Publication Data

US 2006/0133631 A1 Jun. 22, 2006

Related U.S. Application Data

(63) Continuation-in-part of application No. 11/034,144, filed on Jan. 12, 2005, now Pat. No. 7,194,103.

(60) Provisional application No. 60/639,407, filed on Dec. 22, 2004, provisional application No. 60/639,173, filed on Dec. 22, 2004.

(51) Int. Cl.
*H04R 25/00* (2006.01)

(52) U.S. Cl. ..... 381/328; 381/380; 381/372

(58) Field of Classification Search ..... 381/182, 381/320, 321, 322, 328, 368, 71.6, 74, 312, 381/372, 380; 455/575.2; 379/428.01; 181/135
See application file for complete search history.

(56) References Cited

U.S. PATENT DOCUMENTS 3,819,860 A * 6/1974 Miller ..... 381/380
4,548,082 A * 10/1985 Engebretson et al. ..... 381/320
4,677,679 A 6/1987 Killion
4,870,688 A * 9/1989 Voroba et al. ..... 381/322
5,193,116 A 3/1993 Mostardo
5,222,050 A 6/1993 Marren et al.
6,072,885 A * 6/2000 Stockham et al. ..... 381/321
6,137,889 A 10/2000 Shennib et al.

(Continued)

OTHER PUBLICATIONS

Jerry Harvey, Earworn Monitors: All Foldback, No Feedback, Live Sound International, Sep. 2001, Publisher: Live Sound International, Published in: US.

*Primary Examiner*—Brian Ensey
(74) *Attorney, Agent, or Firm*—Patent Law Office of David G. Beck

(57) ABSTRACT

A multi-driver in-ear monitor for use with either a recorded or a live audio source is provided. If a pair of drivers is used, each driver has an individual sound delivery tube. If three drivers are used, the outputs from two of the drivers are merged into a single sound delivery tube while the output from the third driver is maintained in a separate, discrete sound tube. The sound delivery tubes remain separate throughout the end portion of the earpiece. The earpiece tip is configured to be fitted with any of a variety of sleeves (e.g., foam sleeves, flanged sleeves, etc.), thus allowing the in-ear monitor to be easily tailored to comfortably fit within any of a variety of ear canals. Due to the size constraints of such an earpiece, the sound delivery tubes include a transition region. Acoustic filters (i.e., dampers) can be interposed between one or both driver outputs and the earpiece output.

29 Claims, 7 Drawing Sheets

U.S. PATENT DOCUMENTS 6,205,227 B1 3/2001 Mahoney et al.
6,389,143 B1 5/2002 Leedom et al.
6,931,140 B2 * 8/2005 Van Halteren et al. ..... 381/182
7,088,839 B2 * 8/2006 Geschiere et al. ..... 381/368
2002/0025055 A1 * 2/2002 Stonikas et al. ..... 381/322
2006/0045297 A1 * 3/2006 Haussmann ..... 381/322

* cited by examiner

IN-EAR MONITOR WITH SHAPED DUAL BORE

CROSS-REFERENCES TO RELATED APPLICATIONS

This application is a continuation-in-part of U.S. patent application Ser. No. 11/034,144, filed Jan. 12, 2005 now U.S. Pat. No. 7,194,103, and claims the benefit of U.S. Provisional Patent Application Ser. Nos. 60/639,407, filed Dec. 22, 2004, and 60/639,173, filed Dec. 22, 2004, all the disclosures of which are incorporated herein by reference for any and all purposes.

FIELD OF THE INVENTION

The present invention relates generally to audio monitors and, more particularly, to an in-ear monitor.

BACKGROUND OF THE INVENTION

In-ear monitors, also referred to as canal phones and stereo headphones, are commonly used to listen to both recorded and live music. A typical recorded music application would involve plugging the monitor into a music player such as a CD player, flash or hard drive based MP3 player, home stereo, or similar device using the monitor's headphone socket. Alternately, the monitor can be wirelessly coupled to the music player. In a typical live music application, an on-stage musician wears the monitor in order to hear his or her own music during a performance. In this case, the monitor is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, increased mobility for the musician and the reduction of ambient sounds.

In-ear monitors are quite small and are normally worn just outside the ear canal. As a result, the acoustic design of the monitor must lend itself to a very compact design utilizing small components. Some monitors are custom fit (i.e., custom molded) while others use a generic "one-size-fits-all" earpiece.

Prior art in-ear monitors use either diaphragm-based or armature-based receivers. Broadly characterized, a diaphragm is a moving-coil speaker with a paper or mylar diaphragm. Since the cost to manufacture diaphragms is relatively low, they are widely used in many common audio products (e.g., ear buds). In contrast to the diaphragm approach, an armature receiver utilizes a piston design. Due to the inherent cost of armature receivers, however, they are typically only found in hearing aids and high-end in-ear monitors.

Diaphragm receivers, due to the use of moving-coil speakers, suffer from several limitations. First, because of the size of the diaphragm assembly, a typical earpiece is limited to a single diaphragm. This limitation precludes achieving optimal frequency response (i.e., a flat or neutral response) through the inclusion of multiple diaphragms. Second, diaphragm-based monitors have significant frequency roll off above 4 kHz. As the desired upper limit for the frequency response of a high-fidelity monitor is at least 15 kHz, diaphragm-based monitors cannot achieve the desired upper frequency response while still providing accurate low frequency response.

Armatures, also referred to as balanced armatures, were originally developed by the hearing aid industry. This type of driver uses a magnetically balanced shaft or armature within a small, typically rectangular, enclosure. As a result of this design, armature drivers are not reliant on the size and shape of the enclosure, i.e., the ear canal, for tuning as is the case with diaphragm-based monitors. Typically, lengths of tubing are attached to the armature which, in combination with acoustic filters, provide a means of tuning the armature. A single armature is capable of accurately reproducing low-frequency audio or high-frequency audio, but incapable of providing high-fidelity performance across all frequencies.

To overcome the limitations associated with both diaphragm and armature drivers, some in-ear monitors use multiple armatures. In such multiple driver arrangements, a crossover network is used to divide the frequency spectrum into multiple regions, i.e., low and high or low, medium, and high. Separate, optimized drivers are then used for each acoustic region. If the monitor's earpiece is custom fit, generally a pair of delivery tubes delivers the sound produced by the drivers to the output face of the earpiece. Alternately, or if the earpiece is not custom fit, the outputs from the drivers are merged into a single delivery tube, the single tube delivering the sound from all drivers to the earpiece's output face.

Accordingly, what is needed in the art is an in-ear monitor that combines the performance associated with multiple drivers and multiple delivery tubes with the convenience and cost benefits associated with in-ear monitors utilizing non-custom eartips and replaceable sleeves. The present invention provides such a monitor.

SUMMARY OF THE INVENTION

The present invention provides an in-ear monitor for use with either a recorded or a live audio source. The disclosed in-ear monitor combines at least two drivers (e.g., two armature drivers, an armature driver and a diaphragm driver, etc.) within a single earpiece, thereby taking advantage of the capabilities of each type of driver. If a pair of drivers is used, each driver has an individual sound delivery tube. If three drivers are used, the outputs from two of the drivers are merged into a single sound delivery tube while the output from the third driver is maintained in a separate, discrete sound tube. The sound delivery tubes remain separate throughout the end portion of the earpiece. The earpiece tip is configured to be fitted with any of a variety of sleeves (e.g., foam sleeves, flanged sleeves, etc.), thus allowing the in-ear monitor to be easily tailored to comfortably fit within any of a variety of ear canals. Due to the size constraints of such an earpiece, the sound delivery tubes include a transition region where the tubes transition from the relatively large diameter allowed by the outer earpiece to the relatively small diameter required by the earpiece tip portion. In at least one embodiment, acoustic filters (i.e., dampers) are interposed between one or both driver outputs and the earpiece output.

A further understanding of the nature and advantages of the present invention may be realized by reference to the remaining portions of the specification and the drawings.

DESCRIPTION OF THE SPECIFIC EMBODIMENTS

Figure 1:
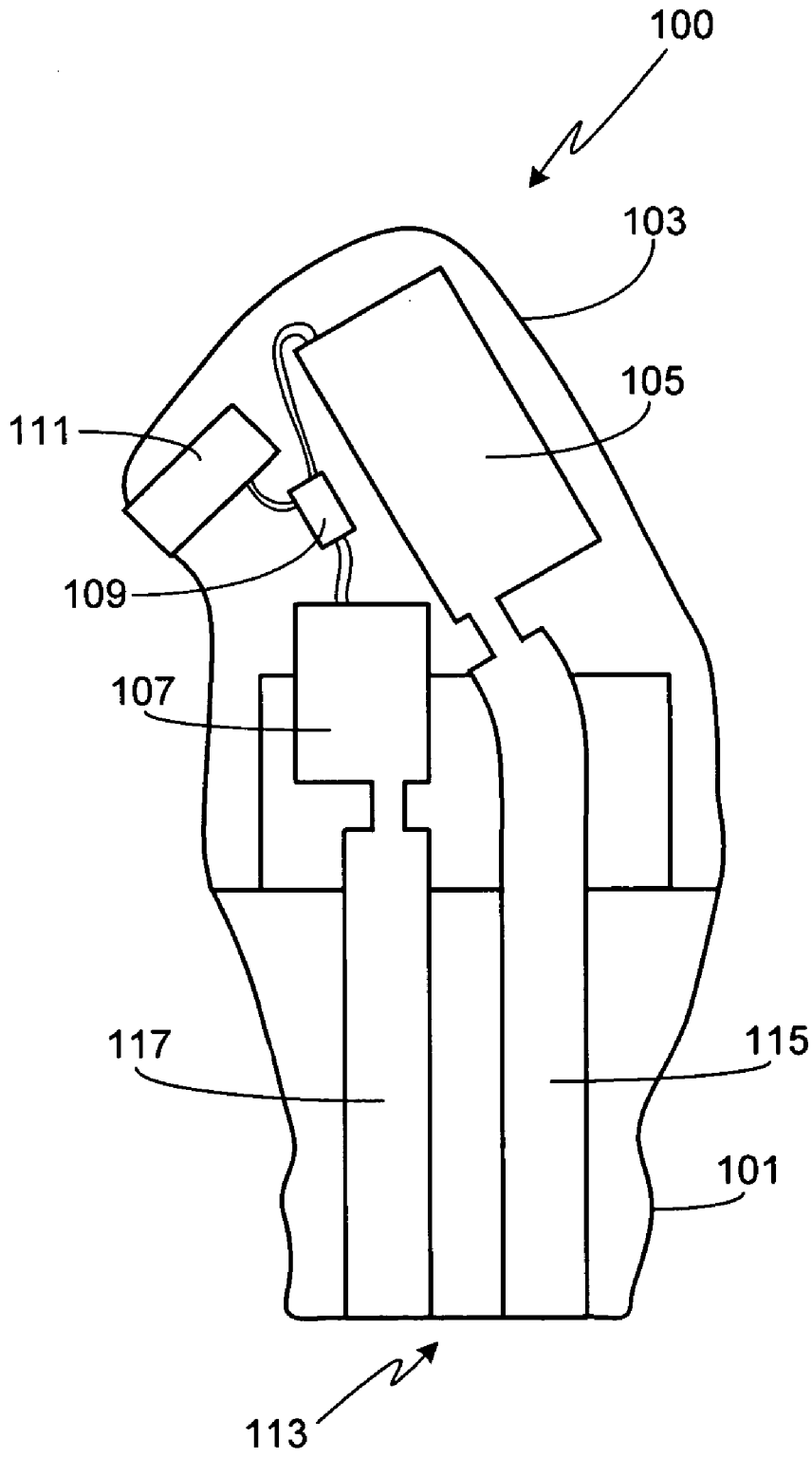
Prior Art FIG. 1
FIG. 1 is a cross-sectional view of a custom fit in-ear monitor according to the prior art.

FIG. 1 is a cross-sectional view of a custom fit in-ear monitor 100 according to the prior art. The term "custom fit" refers to the well known practice in both the in-ear monitor and hearing aid industries of fitting an earpiece to a particular user's ears and, more specifically, to one of the ears of a particular user. In order to custom fit an earpiece, a casting is taken of the user's ear canal and concha. Then an earpiece of the desired type is molded from the casting.

As shown in FIG. 1, monitor 100 includes an ear canal portion 101 designed to fit within the outer ear canal of the user and an concha portion 103 designed to fit within the concha portion of the ear. In the illustrated example, monitor 100 includes a pair of armature drivers 105 and 107, driver 105 being a low-frequency driver and driver 107 being a high-frequency driver. A circuit 109, such as a passive crossover circuit or an active crossover circuit, provides input to armature drivers 105 and 107. Circuit 109 can either be coupled directly via cable (not shown) to an external sound source (not shown) or coupled to the external sound source via a cable attached to cable socket 111. The external sound source may be selected from any of a variety of sources such as an audio receiver, mixer, music player, headphone amplifier or other source type. As is well known in the industry, in-ear monitor 100 can also be wirelessly coupled to the desired source.

The output from drivers 105 and 107 is delivered to the end surface 113 of the earpiece via a pair of delivery tubes 115 and 117, respectively. Because an earpiece of this type is molded to exactly fit the shape of the user's ear, and because the ear canal portion 101 of the earpiece is molded around the delivery tubes (or tube), this type of earpiece is large enough to accommodate a pair of delivery tubes as shown. Typical dimensions for sound delivery tubes, such as tubes 115 and 117, are an inside diameter (ID) of 1.9 millimeters and an outside diameter (OD) of 2.95 millimeters. Given that the end tip (i.e., surface 113) of a custom fit earpiece is approximately 9 millimeters by 11 millimeters, it is clear that such earpieces are sufficiently large for dual sound tubes.

Custom fit earpieces typically provide better performance, both in terms of delivered sound fidelity and user comfort, than generic earpieces. Generic earpieces, however, are generally much less expensive as custom molds are not required and the earpieces can be manufactured in volume. In addition to the cost factor, generic earpieces are typically more readily accepted by the general population since many people find it both too time consuming and somewhat unnerving to have to go to a specialist, such as an audiologist, to be fitted for a custom earpiece.

Figure 2:
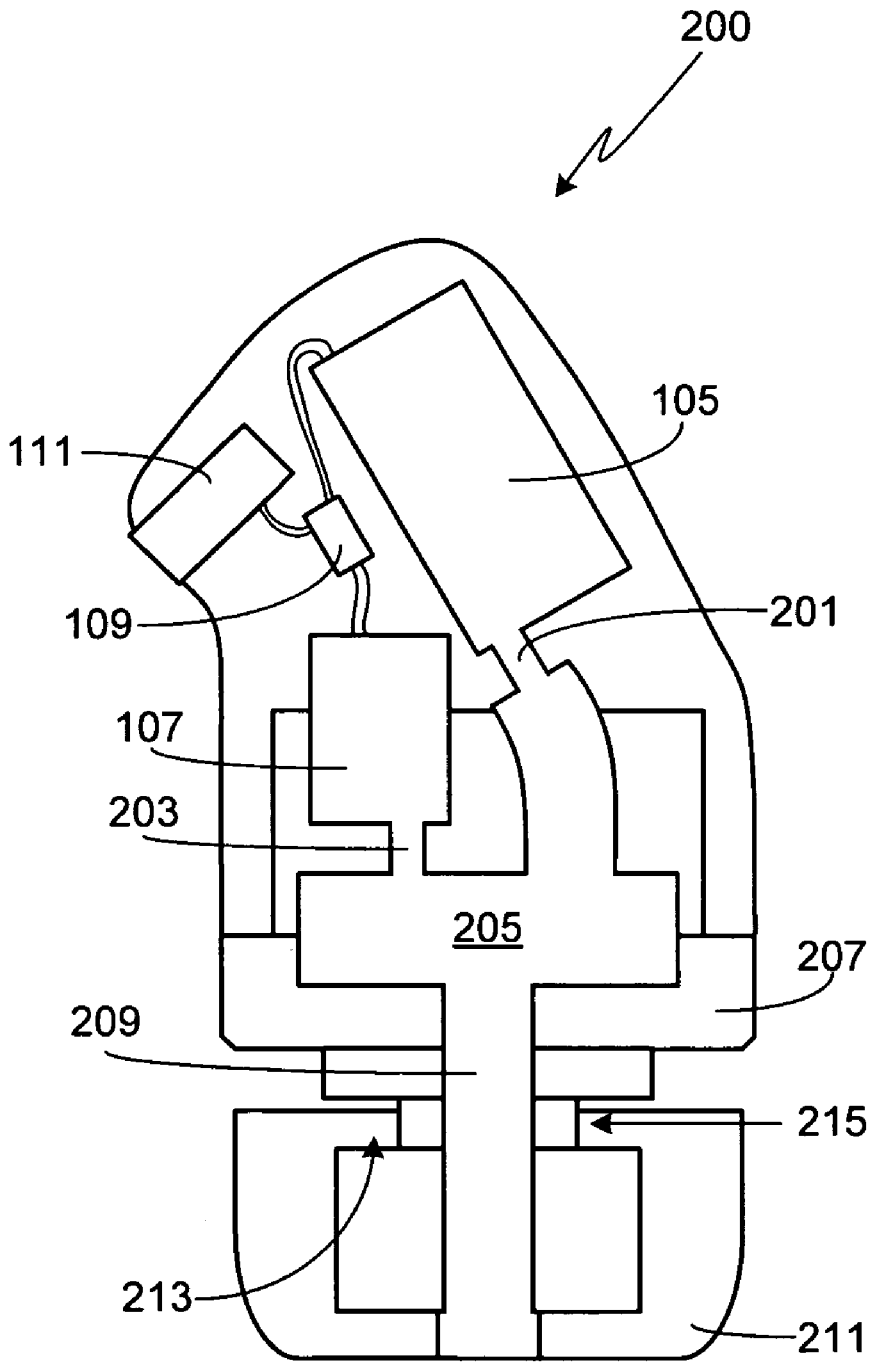
Prior Art FIG. 2
FIG. 2 is a cross-sectional view of a generic in-ear monitor according to the prior art.

FIG. 2 is a cross-sectional view of a generic in-ear monitor 200 in accordance with the prior art. As in the prior example, monitor 200 includes a pair of drivers 105/107, a crossover circuit 109 and a cable socket 111. The outputs 201 and 203 from drivers 105 and 107, respectively, enter an acoustic mixing chamber 205 within sound delivery member 207. A single sound delivery tube 209 delivers the mixed audio from the two drivers through the sound delivery member 207 to the user. Sound delivery member 207 is designed to fit within the outer ear canal of the user and as such, is generally cylindrical in shape. To provide the user with the desired fit, a removable and easily replaceable sleeve 211 (also referred to as an eartip sleeve) is fit to sound delivery member 207. Sleeve 211 can be fabricated from any of a variety of materials including foam, plastic and silicon based material. Sleeve 211 can have the generally cylindrical and smooth shape shown in FIG. 2, or can include one or more flanges. To hold sleeve 211 onto member 207 during normal use but still allow the sleeve to be replaced when desired, typically the sleeve includes a lip 213 which is fit into a corresponding channel or groove 215 in sound delivery member 207. The combination of an interlocking groove 215 with a lip 213 provides a convenient means of replacing sleeve 211, allowing sleeves of various sizes, colors, materials, material characteristics (density, compressibility), or shape to be easily attached to in-ear monitor 200. As a result, it is easy to provide the end user with a comfortable fit at a fraction of the cost of a custom fit in-ear monitor (e.g., monitor 100).

The examples shown in FIGS. 1 and 2 are only meant to illustrate prior art approaches to including multiple drivers within a single in-ear monitor. It should be understood that these examples are not meant to be exhaustive of the prior art systems. For example, it is quite common for a multi-driver custom fit earpiece to use an acoustic mixing chamber and a single sound delivery tube. Alternately, a simple "Y" configuration can be used with either a custom fit or a generic earpiece to combine the outputs from multiple drivers into a single sound delivery tube. With respect to a generic earpiece such as that shown in FIG. 2, it will be appreciated that the primary constraint placed on the size and/or number of sound delivery tubes is the inner diameter of the smallest region of the sound delivery member, i.e., the ID of grooved region 215 of monitor 200. A typical ID for this region is 4.8 millimeters.

FIGS. 3-7 illustrate a preferred embodiment of the invention. As in the prior art examples provided above, monitor 300 includes a pair of drivers 105/107, a crossover circuit 109 and a cable socket 111. It will be appreciated that the invention is not limited to armature drivers. For example, the combination of an armature driver and a diaphragm driver can be used with the invention. Similarly, the invention can utilize a pair of diaphragms and a single armature.

In addition to the previously described components, in-ear monitor 300 also includes a sound delivery member 301 and an attached exterior housing 303. Preferably a boot member 305 attaches to sound delivery member 301, boot member 305 securing the components to the sound delivery member while still providing a means of including acoustic filters as described more fully below. As with in-ear monitor 200, monitor 300 includes a removable sleeve 211 (e.g., foam sleeve, silicon sleeve, flanged sleeve, etc.) which is attached by interlocking sleeve lip 213 onto groove 307 of member 301.

Figure 3:
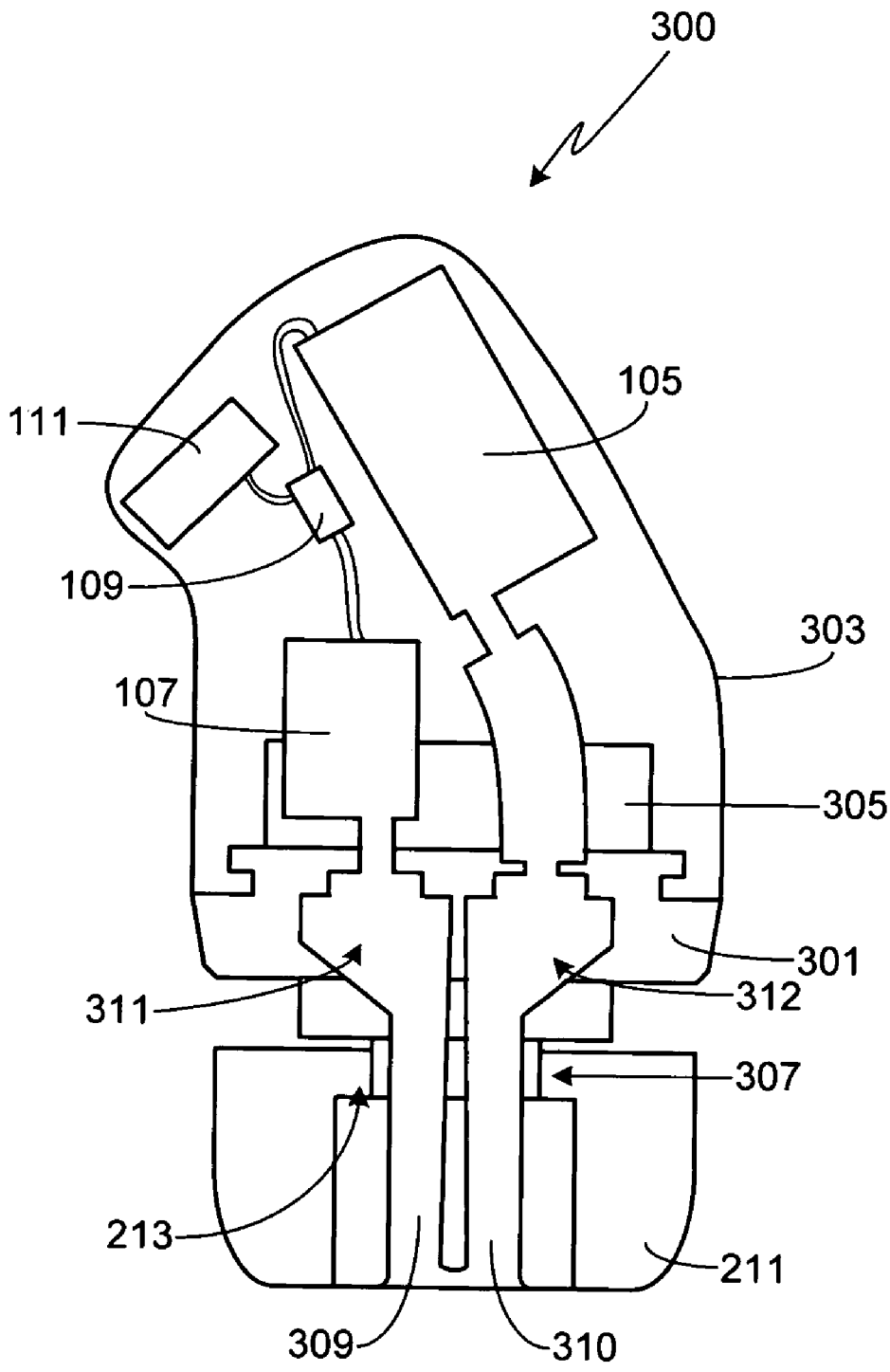
FIG. 3 is a cross-sectional view of a preferred embodiment of the invention utilizing a pair of armature drivers.

Sound delivery member 301 is preferably molded. Fabricated within sound delivery member 301, preferably via the molding process, are two separate delivery tubes 309/310. As shown in FIG. 3, and in more detail in FIGS. 4-7, sound delivery tubes 309/310 include transition regions 311/312, respectively. Regions 311/312 redirect the sound emitted by the drivers, optimizing sound emission and acoustics while still allowing two delivery tubes to pass through the small ID of member 301, in particular the necked down region 307 of member 301.

Figure 4:
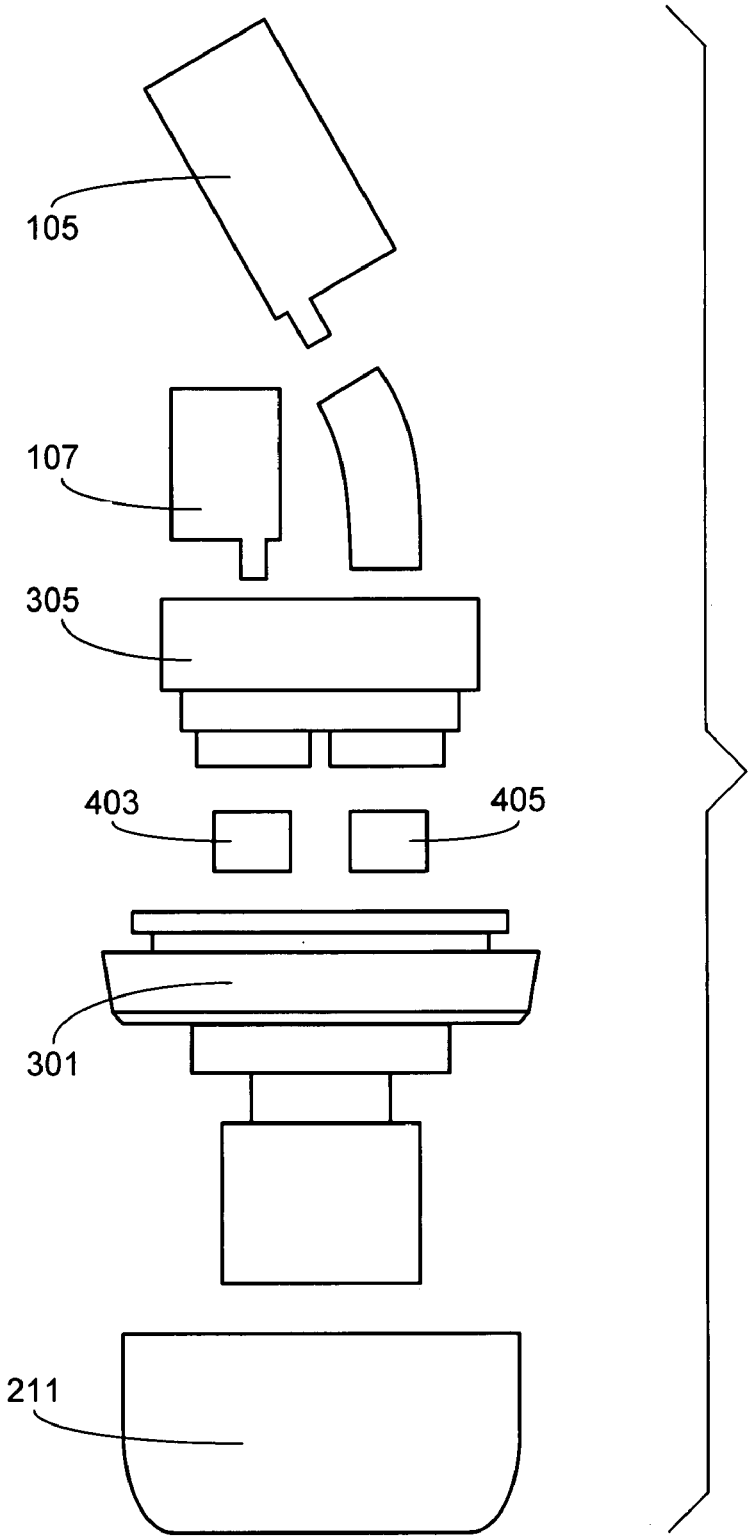
FIG. 4 is an exploded view of the embodiment shown in FIG. 3.

FIG. 4 is an exploded view of the primary acoustic/mechanical components of in-ear monitor 300. Accordingly, the internal wiring, crossover circuit, cable socket and protective exterior housing are not shown in this view. As previously noted, although boot member 305 is not required by the invention, the inventors have found that it not only provides a means for holding many of the components in place, e.g., driver 107, it also provides a convenient means for inserting acoustic dampers into one or both sound delivery tubes. More specifically, in at least one embodiment of the invention, captured between members 301 and 305, and corresponding to drivers 107/105, is a pair of filters 403/405. Alternately, a single filter can be used, corresponding to either driver 105 or driver 107. The use of filters allows the output from the in-ear monitor 300 in general, and the output from either driver in particular, to be tailored. Tailoring may be used, for example, to reduce the sound pressure level overall or to reduce the levels for a particular frequency range or from a particular driver.

Figure 5:
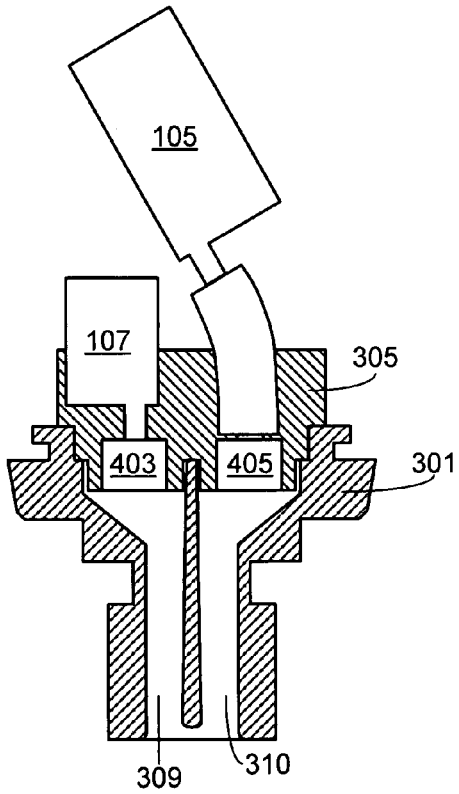
FIG. 5 is a cross-sectional view of the sound delivery member and the boot shown in FIGS. 3 and 4.

FIG. 5 is a second cross-sectional view of the preferred embodiment of the invention, this cross-sectional view providing additional detail such as the inclusion of filters 403 and 405.

Figure 6:
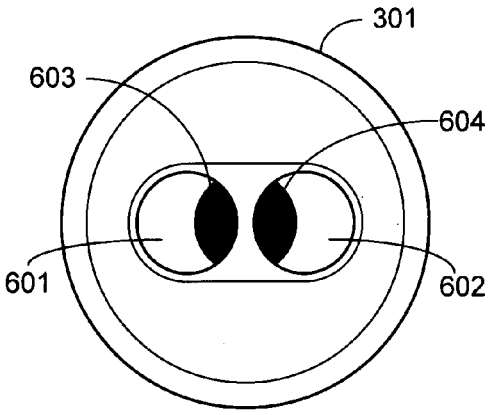
FIG. 6 is a view of the input surface of the sound delivery member of FIGS. 3-5.
Figure 7:
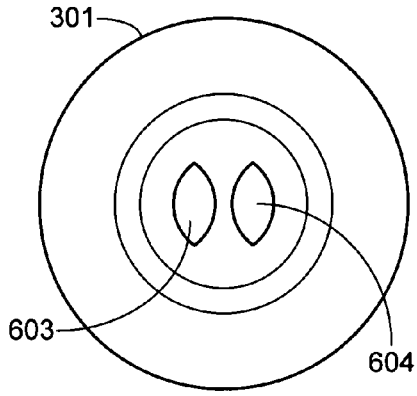
FIG. 7 is a view of the output surface of the sound delivery member shown in FIG. 6.

FIG. 6 is a view of the input surface of sound delivery member 301. This view shows the input ports 601 and 602 for sound delivery tubes 309 and 310, respectively. Shaded regions 603 and 604 indicate the exit ports for sound delivery tubes 309 and 310, respectively. FIG. 7 is a view of the output surface of sound delivery member 301 and as such, provides another view of sound delivery tube exit ports 603 and 604. FIGS. 6 and 7 illustrate the requirement for angled transition regions 311 and 312 in order to pass through the relatively narrow ID of sound delivery member 301, in particular at necked-down region 307. Additionally, sound delivery tubes 309 and 310 must be sized appropriately in order to pass through this same region. In the preferred embodiment of the invention, sound delivery tubes 309 and 310 are compressed, and somewhat flattened, yielding the final double tear-drop shape shown in FIGS. 6 and 7. It will be appreciated that this shape, although preferred, is not required by the invention. For example, back-to-back "D" shaped ports would provide sound throughput while still providing sufficient compression to pass through member 301.

Figure 8:
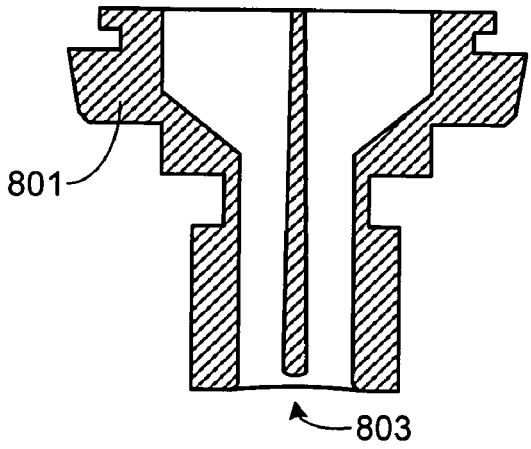
FIG. 8 is a cross-sectional view of an alternate sound delivery member with a concave output surface.

FIG. 8 is a cross-sectional view of an alternate preferred sound delivery member 801. The only difference between members 301 and 801 is that the output surface 803 of member 801 has a concave surface.

Figure 9:
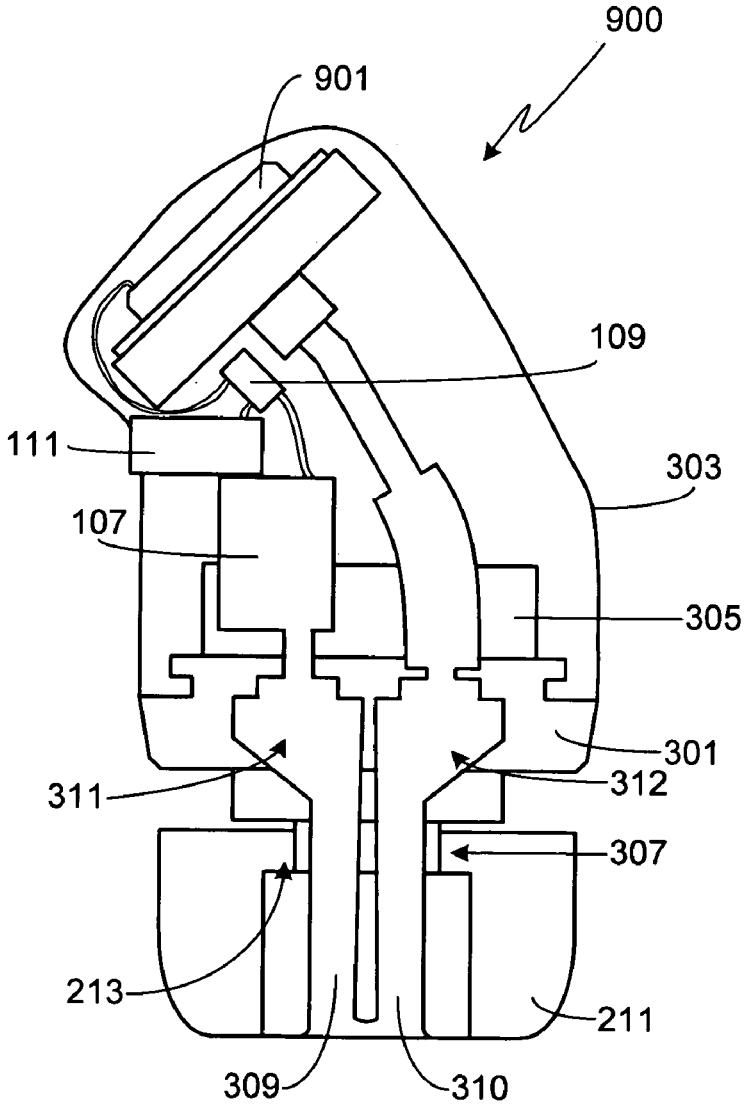
FIG. 9 is a cross-sectional view of an alternate embodiment of the invention utilizing an armature and a diaphragm.
Figure 10:
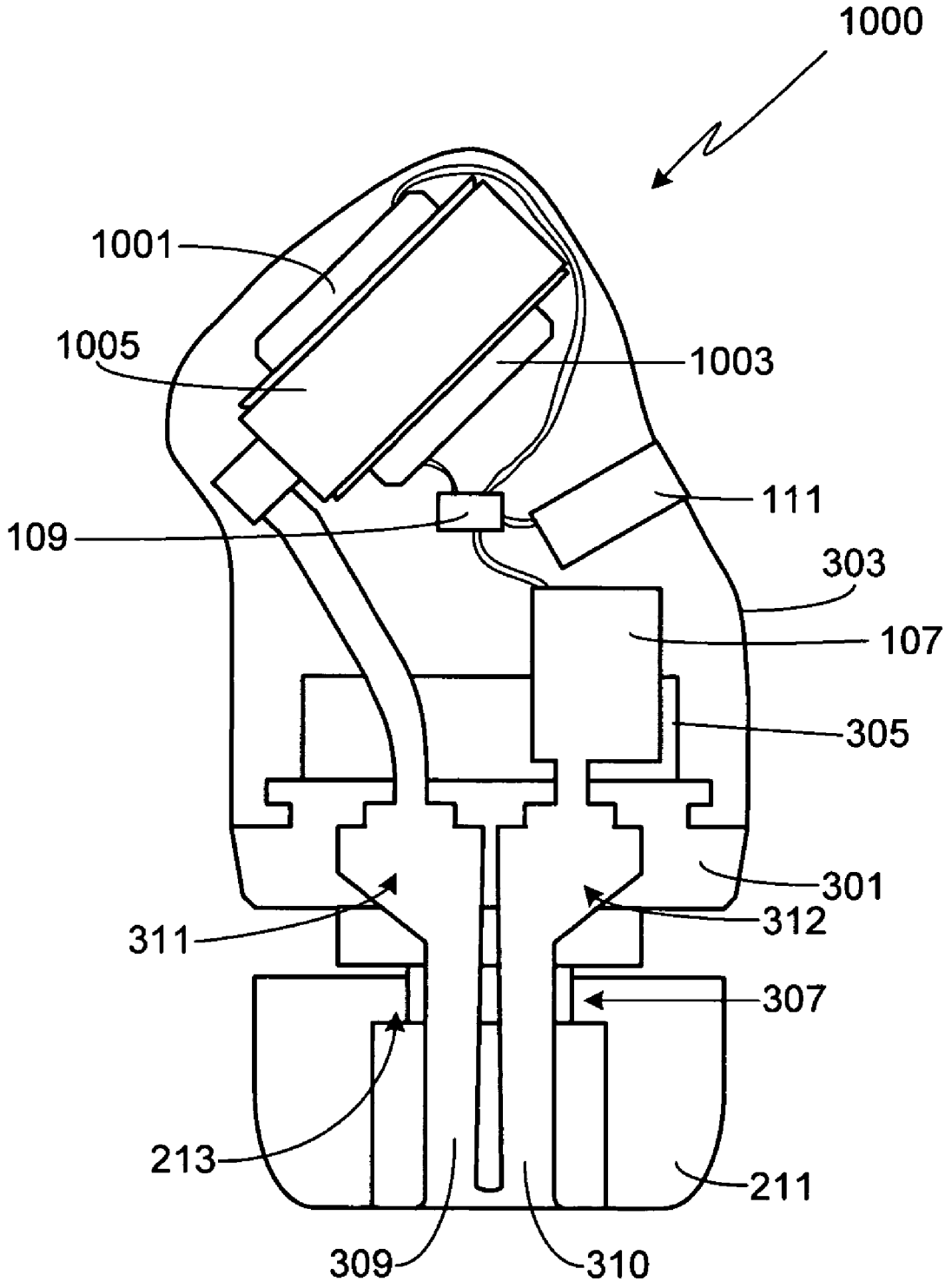
FIG. 10 is a cross-sectional view of an alternate embodiment of the invention utilizing an armature and a pair of diaphragms.

As previously noted, the present invention can utilize either, or both, armature drivers and diaphragm drivers. The primary constraints placed on the invention are that a pair of sound delivery tubes is employed and that the sound delivery member is configured to accept replaceable eartip sleeves. Exemplary alternate embodiments of the invention are shown in FIGS. 9 and 10. In-ear monitor 900 is the same as that shown in FIG. 3 except that the low-frequency armature driver 105 is replaced with a low-frequency diaphragm driver 901. In-ear monitor 1000 is the same as that shown in FIG. 3 except that the low-frequency armature driver 105 is replaced with a pair of low-frequency diaphragm drivers 1001 and 1003, the outputs of which are directed into a diaphragm enclosure 1005.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

What is claimed is:

1. An in-ear monitor comprising:

an in-ear monitor enclosure;

a first driver disposed within said in-ear monitor enclosure and having a first acoustic output;

a second driver disposed within said in-ear monitor enclosure and having a second acoustic output; and a source input cable attached to said in-ear monitor enclosure, wherein said source input cable is coupleable to a source and receives an electrical signal from said source, wherein said electrical signal represents a sound to be generated by the in-ear monitor, wherein said source is external to said in-ear monitor enclosure, and wherein said source is selected from the group of sources consisting of music players, mixers and headphone amplifiers;

a circuit contained within said in-ear monitor enclosure and electrically coupled to said first driver, said second driver and said source input cable, wherein said electrical signal from said source is feed through said circuit, said circuit providing a first input signal to said first driver and a second input signal to said second driver;

a sound delivery member coupled to said in-ear monitor enclosure, wherein said sound delivery member has an integrated first sound delivery tube extending through the entire length of said sound delivery member and an integrated second sound delivery tube extending through the entire length of said sound delivery member, wherein said first and second sound delivery tubes are discrete within said sound delivery member, wherein said first acoustic output is acoustically coupled to an acoustic input of said first sound delivery tube and said second acoustic output is acoustically coupled to an acoustic input of said second sound delivery tube, and wherein said sound delivery member is configured to accept a removable sleeve.

2. An in-ear monitor comprising:

an in-ear monitor enclosure;

means for receiving a signal from an external source;

a first driver disposed within said in-ear monitor enclosure and electrically coupled to said receiving means, said first driver having a first acoustic output;

a second driver disposed within said in-ear monitor enclosure and electrically coupled to said receiving means, said second driver having a second acoustic output; and a sound delivery member coupled to said in-ear monitor enclosure, wherein said sound delivery member has an integrated first sound delivery tube extending through the entire length of said sound delivery member and an integrated second sound delivery tube extending through the entire length of said sound delivery member, wherein said first and second sound delivery tubes are discrete within said sound delivery member, wherein said first acoustic output is acoustically coupled to an acoustic input of said first sound delivery tube and said second acoustic output is acoustically coupled to an acoustic input of said second sound delivery tube, and wherein said sound delivery member is configured to accept a removable sleeve, wherein said first sound delivery tube further comprises a first transition region for transitioning from a first inside diameter to a second inside diameter, and wherein said second sound delivery tube further comprises a second transition region for transitioning from a third inside diameter to a fourth inside diameter.

3. The in-ear monitor of claim 2, wherein said first and second transition regions reduce a center-to-center spacing between said first and second sound delivery tubes.

4. An in-ear monitor comprising:

an in-ear monitor enclosure;

means for receiving a signal from an external source;

a first driver disposed within said in-ear monitor enclosure and electrically coupled to said receiving means, said first driver having a first acoustic output;

a second driver disposed within said in-ear monitor enclosure and electrically coupled to said receiving means, said second driver having a second acoustic output; and a sound delivery member coupled to said in-ear monitor enclosure, wherein said sound delivery member has an integrated first sound delivery tube extending through the entire length of said sound delivery member and an integrated second sound delivery tube extending through the entire length of said sound delivery member, wherein said first and second sound delivery tubes are discrete within said sound delivery member, wherein said first acoustic output is acoustically coupled to an acoustic input of said first sound delivery tube and said second acoustic output is acoustically coupled to an acoustic input of said second sound delivery tube, and wherein said sound delivery member is configured to accept a removable sleeve, wherein a first output port corresponding to said first sound delivery tube and a second output port corresponding to said second sound delivery tube each have a double teardrop shape.

5. The in-ear monitor of claim 1, wherein an output surface of said sound delivery member is concave.

6. The in-ear monitor of claim 1, said in-ear monitor enclosure further comprising a cable socket, wherein said source input cable is attached to said in-ear monitor enclosure via said cable socket.

7. The in-ear monitor of claim 1, said circuit comprising a passive crossover circuit.

8. The in-ear monitor of claim 1, said circuit comprising an active crossover circuit.

9. The in-ear monitor of claim 1, further comprising a filter interposed between said first acoustic output and said first sound delivery tube.

10. The in-ear monitor of claim 1, further comprising a filter interposed between said second acoustic output and said second sound delivery tube.

11. The in-ear monitor of claim 1, further comprising a boot member coupled to said sound delivery member.

12. An in-ear monitor comprising:

an in-ear monitor enclosure;

means for receiving a signal from an external source;

a first driver disposed within said in-ear monitor enclosure and electrically coupled to said receiving means, said first driver having a first acoustic output;

a second driver disposed within said in-ear monitor enclosure and electrically coupled to said receiving means, said second driver having a second acoustic output; and a sound delivery member coupled to said in-ear monitor enclosure, wherein said sound delivery member has an integrated first sound delivery tube extending through the entire length of said sound delivery member and an integrated second sound delivery tube extending through the entire length of said sound delivery member, wherein said first and second sound delivery tubes are discrete within said sound delivery member, wherein said first acoustic output is acoustically coupled to an acoustic input of said first sound delivery tube and said second acoustic output is acoustically coupled to an acoustic input of said second sound delivery tube, and wherein said sound delivery member is configured to accept a removable sleeve;

a boot member coupled to said sound delivery member; and a first filter interposed between said boot member and said sound delivery member.

13. The in-ear monitor of claim 12, further comprising a second filter interposed between said boot member and said sound delivery member.

14. The in-ear monitor of claim 1, wherein said first driver comprises a first armature driver and said second driver comprises a second armature driver.

15. An in-ear monitor comprising:

an in-ear monitor enclosure;

means for receiving a signal from an external source;

a first diaphragm driver disposed within said in-ear monitor enclosure and electrically coupled to said receiving means, said first diaphragm driver having a first acoustic output;

a second diaphragm driver disposed within said in-ear monitor enclosure and electrically coupled to said receiving means, said second diaphragm driver having a second acoustic output, wherein said first and second acoustic outputs are acoustically combined to form a third acoustic output;

an armature driver disposed within said in-ear monitor enclosure and electrically coupled to said receiving means, said armature driver having a fourth acoustic output; and a sound delivery member coupled to said in-ear monitor enclosure, wherein said sound delivery member has an integrated first sound delivery tube extending through the entire length of said sound delivery member and an integrated second sound delivery tube extending through the entire length of said sound delivery member, wherein said first and second sound delivery tubes are discrete within said sound delivery member, wherein said third acoustic output is acoustically coupled to an acoustic input of said first sound delivery tube and said fourth acoustic output is acoustically coupled to an acoustic input of said second sound delivery tube, and wherein said sound delivery member is configured to accept a removable sleeve.

16. The in-ear monitor of claim 15, further comprising a diaphragm enclosure disposed within said in-ear monitor enclosure, wherein said first and second acoustic outputs are directed into said diaphragm enclosure, and wherein said third acoustic output is coupled to said diaphragm enclosure.

17. The in-ear monitor of claim 15, wherein said first sound delivery tube further comprises a first transition region for transitioning from a first inside diameter to a second inside diameter, and wherein said second sound delivery tube further comprises a second transition region for transitioning from a third inside diameter to a fourth inside diameter.

18. The in-ear monitor of claim 17, wherein said first and second transition regions reduce a center-to-center spacing between said first and second sound delivery tubes.

19. The in-ear monitor of claim 15, wherein a first output port corresponding to said first sound delivery tube and a second output port corresponding to said second sound delivery tube each have a double tear-drop shape.

20. The in-ear monitor of claim 15, wherein an output surface of said sound delivery member is concave.

21. The in-ear monitor of claim 15, said receiving means further comprising a cable coupleable to said external source.

22. The in-ear monitor of claim 15, said receiving means further comprising a cable socket.

23. The in-ear monitor of claim 15, said receiving means further comprising a passive crossover circuit, said passive crossover circuit supplying a first electrical signal to said first driver and a second electrical signal to said second driver.

24. The in-ear monitor of claim 15, said receiving means further comprising an active crossover circuit, said active crossover circuit supplying a first electrical signal to said first driver and a second electrical signal to said second driver.

25. The in-ear monitor of claim 15, further comprising a filter interposed between said first acoustic output and said first sound delivery tube.

26. The in-ear monitor of claim 15, further comprising a filter interposed between said second acoustic output and said second sound delivery tube.

27. The in-ear monitor of claim 15, further comprising a boot member coupled to said sound delivery member.

28. The in-ear monitor of claim 27, further comprising a first filter interposed between said boot member and said sound delivery member.

29. The in-ear monitor of claim 28, further comprising a second filter interposed between said boot member and said sound delivery member.

* * * * *